US006546681B1

(12) United States Patent
Trundle

(10) Patent No.: US 6,546,681 B1
(45) Date of Patent: Apr. 15, 2003

(54) ALUMINUM/PLASTIC COMBINATION ACCORDION STORM SHUTTER BLADE

(76) Inventor: Wayne Trundle, 729 Pleasent Hill Rd., Ranger, GA (US) 30734

( * ) Notice: Subject to any disclaimer, the term of this patent is extended or adjusted under 35 U.S.C. 154(b) by 0 days.

(21) Appl. No.: 09/512,613

(22) Filed: Feb. 25, 2000

(51) Int. Cl.[7] ..... E06B 3/26

(52) U.S. Cl. ..... 52/202; 16/225; 160/199; 160/183; 49/402

(58) Field of Search ..... 52/202; 160/199, 160/206, 235, 183

(56) References Cited

U.S. PATENT DOCUMENTS 5,099,904 A * 3/1992 Susnar ..... 160/199
5,549,148 A * 8/1996 Figueiredo et al. ..... 160/183
5,729,867 A * 3/1998 Carmichael ..... 16/225
6,151,834 A * 11/2000 Oami et al. ..... 49/402

* cited by examiner

*Primary Examiner*—Carl D. Friedman
*Assistant Examiner*—Steve Varner

(57) ABSTRACT

A combination blade of aluminum hinges and shatter resistant transparent plastic web used to replace metal blades of accordion storm shutters used to protect glass windows and doors in homes, office buildings, and other walled structures from the destructive force of storm systems, such as hurricanes. The present combination blade assembly includes a flat sheet of shatter-resistant and transparent plastic material forming a web between a male and female aluminum hinge. The hinges and web are held together with urethane adhesive that also forms and hardens into a mechanical spline for additional joint strength due to the hinge shape. The hinges are shaped to be interchangeable with metal blades used to make accordion storm shutters. The metal blades can be replaced with combination blades using the same methods and hardware.

9 Claims, 4 Drawing Sheets

ALUMINUM/PLASTIC COMBINATION ACCORDION STORM SHUTTER BLADE

FIELD OF INVENTION

The present invention relates to accordion storm shutters and, more particularly, to transparent blades of aluminum and plastic for accordion storm shutters to protect glass windows and doors in homes, office buildings and other walled structures from the destructive force of storm systems, such as hurricanes.

BACKGROUND OF THE INVENTION

Violent storms are natural phenomena that often generate winds having the potential for destruction of property and life. This potential is evidenced upon review of the storm systems known as Hurricane Hugo and Hurricane Andrew that struck the eastern coast of the United States. Hurricane Andrew was especially destructive taxing the entire nation in the form of rebuilding costs and insurance rates. In light of the escalating costs for rebuilding, home owners, business owners and insurance companies alike have a common goal in protecting property. Proper shuttering of windows and doors, typically the weakest portion of a structure, has become a necessity if the structure's contents are to be protected.

The study of storms has determined that storm shutters must withstand more than just high winds. In reality the majority of the destruction is a direct result of impacts by debris carried by these high winds. In an effort to reduce the destructive effect of such windborne debris, changes to the building codes in areas frequently subjected to these type storm systems have been made, notably first in South Florida, then throughout Florida with the introduction of the new State of Florida Building Code, then the southeast coastal states with the new Southern Building Congress Code SSTD 12-99 and next internationally, with the International Building Code due to be released next year. One change made included in all these codes require that storm shutters withstand a large missile impact test. Testing is performed by projecting a large object, such as a length of two by four lumber, at a velocity of 50 feet per second or higher, against the storm shutter being tested. This is intended to simulate the impact of windborne debris in a hurricane or similar storm. To successfully pass, the shutter must remain intact after the projectile has impacted it.

Along with providing protection from such windborne debris, it has been found desirable for storm shutters to be constructed of translucent materials so as not to nullify the main purpose of transparent glass windows and doors, especially when the electricity has been lost in a storm. The transparent materials prevent claustrophobic tendencies of occupants secured within the structure yet permits law enforcement officials to inspect shuttered structures.

A number of U.S. Patent numbers, notably U.S. Pat. No. 4,685,261, 4,175,357, 5,228,238 and 5,457,921, disclose various types of translucent storm shutter assemblies having a transparent panel constructed of flat plastic such as polycarbonate and mounted in a frame of aluminum or steel or a corrugated plastic such as polycarbonate reinforced with aluminum or steel. The plastic sheet used in the '261 and '357 patents is firmly secured to a frame with little if any allowance for expansion and contraction relative to the frame. Such restriction can cause the shutter assembly to become damaged even without exposure to storms. The plastic sheet used in the '238 patent, on the other hand, is mounted to its frame so as to allow each sheet relative freedom to expand and contract. As taught by the '238 patent, this problem may be avoided by mounting each plastic sheet in a frame so that it is relatively unrestricted and free to change in size in response to temperature changes. In order to accomplish this, however, the '238 patent discloses a very elaborate and thus relatively expensive storm shutter assembly. The '921 patent discloses a corrugated sheet of plastic such as polycarbonate, that was made of material 0.062 to 0.125 thick about 13 inch wide. The '921 patent shows a storm shutter that had to be put up in pieces and reinforced with aluminum or steel braces. This made the shutter very consumer unfriendly, and worse yet with the new building codes unable to pass the new impact standards.

A common problem shared by transparent storm shutters of the prior art is that in order to successfully pass the current missile impact test, like previously described, each plastic sheet is relatively thick, typically on the order of a 0.5 inch or more. with a jigsaw puzzle of reinforcement. Since impact plastics such as polycarbonate are relatively expensive and heavy, these designs cannot compete in the market. At other end of the spectrum are the thin lighter impact plastics such as corrugated polycarbonate reinforced with steel or aluminum braces that are consumer unfriendly and still can not pass the code mandated large missile impact test, thus become unmarketable.

Therefore, there is a need for a transparent storm shutter that is relatively inexpensive to manufacture, is compatible with current shutter systems, and is easy to install, yet capable of withstanding direct impacts from windborne debris during a storm.

SUMMARY OF THE INVENTION

The present invention is directed to a relatively inexpensive Combination Blade of extruded aluminum and transparent impact plastic such as polycarbonate, this Combination Blade is made to replace the metal blades currently used to manufacture accordion shutters. It is lightweight and of relatively simple construction, it is made with several hinge configurations so it can be used with many of the accordion shutters on the market today. It can be used to retrofit existing and/or make new accordion shutters. It is easy to install, yet capable of sufficiently resisting direct impacts from windborne debris during a storm.

The present invention is to be used with an accordion shutter assembly to protect glass windows and doors in homes, office buildings and other walled structures from the destructive force of storm systems, such as hurricanes. The present Combination Blade includes two mating hinges of aluminum assembled together with a flat sheet of transparent plastic, such as polycarbonate, that is held together with an urethane adhesive that actual forms a spline, giving it a mechanical and adhesive joint of unusual high strength due to the shape of the hinges. The present Combination Blade can then be assembled into an accordion shutter assembly, replacing all or some of the metal blades, using the same hex head bolts, flat washers, nylon bushings and roller assemblies normally used for assembling an accordion shutter assembly. The accordion shutter assembly is then firmly secured to a walled structure in the same manner as it always has been, the Combination Blade having no effect on the attachment.

In one embodiment of the present Combination Blade, it replaces a metal blade in an existing accordion shutter using the same hex head bolts, flat washers, nylon bushings, and roller assemblies and methods used to install a metal blade.

In other embodiments, as will be discussed in greater detail hereafter, the Combination Blade can be used in the manufacturing of new accordion shutters, it can be used for all the blades to make a completely transparent shutter or in proportion to make a partially transparent window. This will give the building occupants, when a storm is imminent and the accordion shutters are closed, light inside and the ability to see the outside conditions. Still being secure by knowing flying debris will be deflected.

In embodiments where the Combination Blades are kept 8 inches or less in width, it has been found a much thinner sheet of transparent plastic can be used such as 0.093 polycarbonate sheet. In order to provide additional impact resistance against windborne debris there are serrations in the aluminum hinges that are filled with a urethane adhesive used to assembly the blade, that becomes a spline when hardened and adds a great deal of strength to the joints. The plastic such as polycarbonate being held on only two sides, contrary to prior art, defeats the chance of damage from thermal expansion and contraction. Further, because each Combination Blade has the exact hinge configuration as the all-metal blade it replaces, it needs no additional hardware, it mounts with the same hex head bolts, flat washers, nylon bushings, roller assemblies and methods used to mount a metal blade, making it easy to use with nothing new to learn, less elaborate, and less expensive making it much more consumer friendly than mounting systems used in prior transparent storm shutters.

To replace a metal blade with a Combination Blade the folding blade assembly of an accordion shutter assembly is removed from the assembly. Then the hex head bolts, flat washers, nylon bushings and roller assemblies are removed from the top and bottom of the existing blade, the blade is slid out and a Combination Blade is slid in its place, the hex head bolts, flat washers, nylon bushings and roller assemblies are replaced, then the folding blade assembly is replaced in the accordion shutter assembly.

It has also been found that an additional benefit of the particular construction of the present Combination Blade enables thinner sheets of transparent plastic material to be used while still providing a better degree of impact protection previously provided by thicker flat sheets of the same material.

Another objective of the present invention with aluminum hinges mounted on only two sides is to teach a plastic panel may be secured in place and not restrict the thermal expansion and contraction of the plastic sheets with no chance of damage.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof

REFERENCE NUMERALS IN DRAWINGS

| | | | |
|---|---|---|---|
| 10 | Combination blade | 12 | Accordion shutter assembly |
| 16 | Existing metal blade | 18 | Header |
| 19 | Sill | 20 | Male aluminum hinge |
| 22 | Female aluminum hinge | 24 | Web of transparent plastic sheet |
| 26 | Adhesive spline | 30 | Hex head bolt |
| 32 | Flat washer | 34 | Nylon bushing |
| 36 | Roller Assembly | | |

DETAILED DESCRIPTION OF THE INVENTION

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

The present invention is directed to a transparent Combination Blade assembly 10 that fits into a accordion shutter assembly 12 for protecting a glass window or door (not shown) from the high force winds and windborne debris typical of storm systems such as hurricanes.

Figure 1:
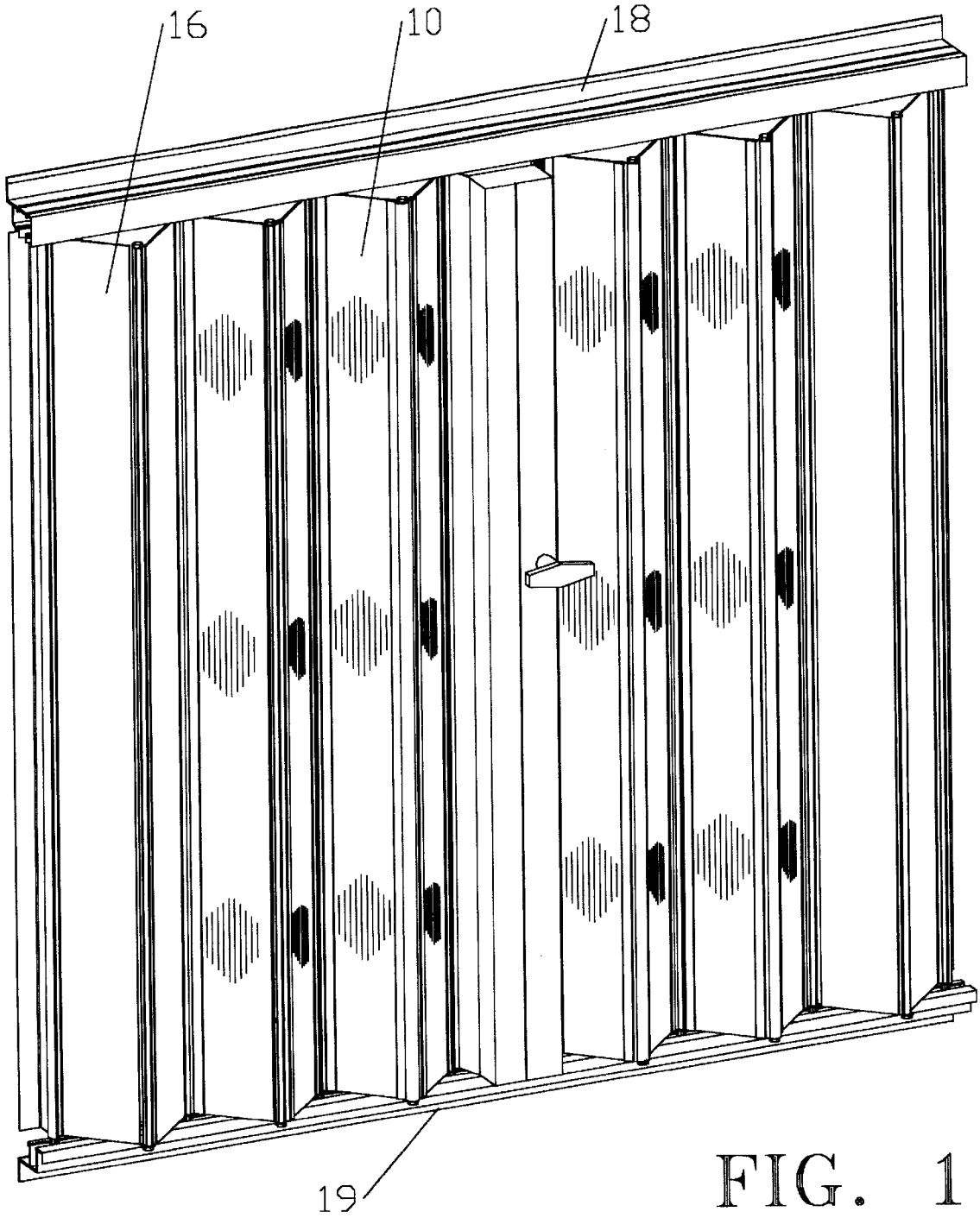
FIG. 1 is a perspective view of one embodiment of the present Combination Blade assembly mounted in an accordion shutter assembly, as it would be used to cover and protect a window or door opening in a structure.
Figure 2:
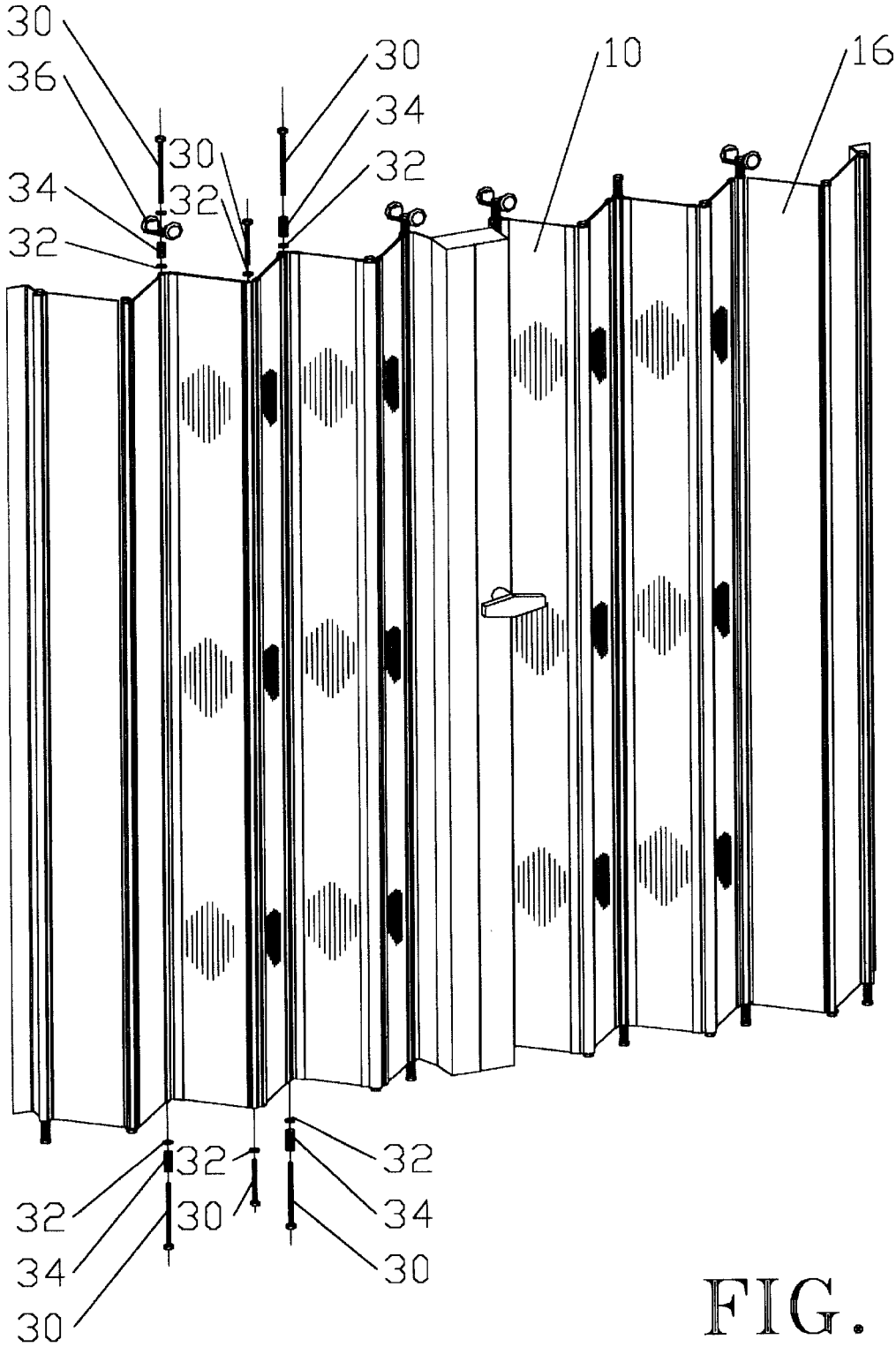
FIG. 2 is a perspective of the present Combination Blade mounted in an accordion shutter assembly without the header or sill to show the blade mounting hex head bolts, flat washers, nylon bushings and roller assemblies.
Figure 3:
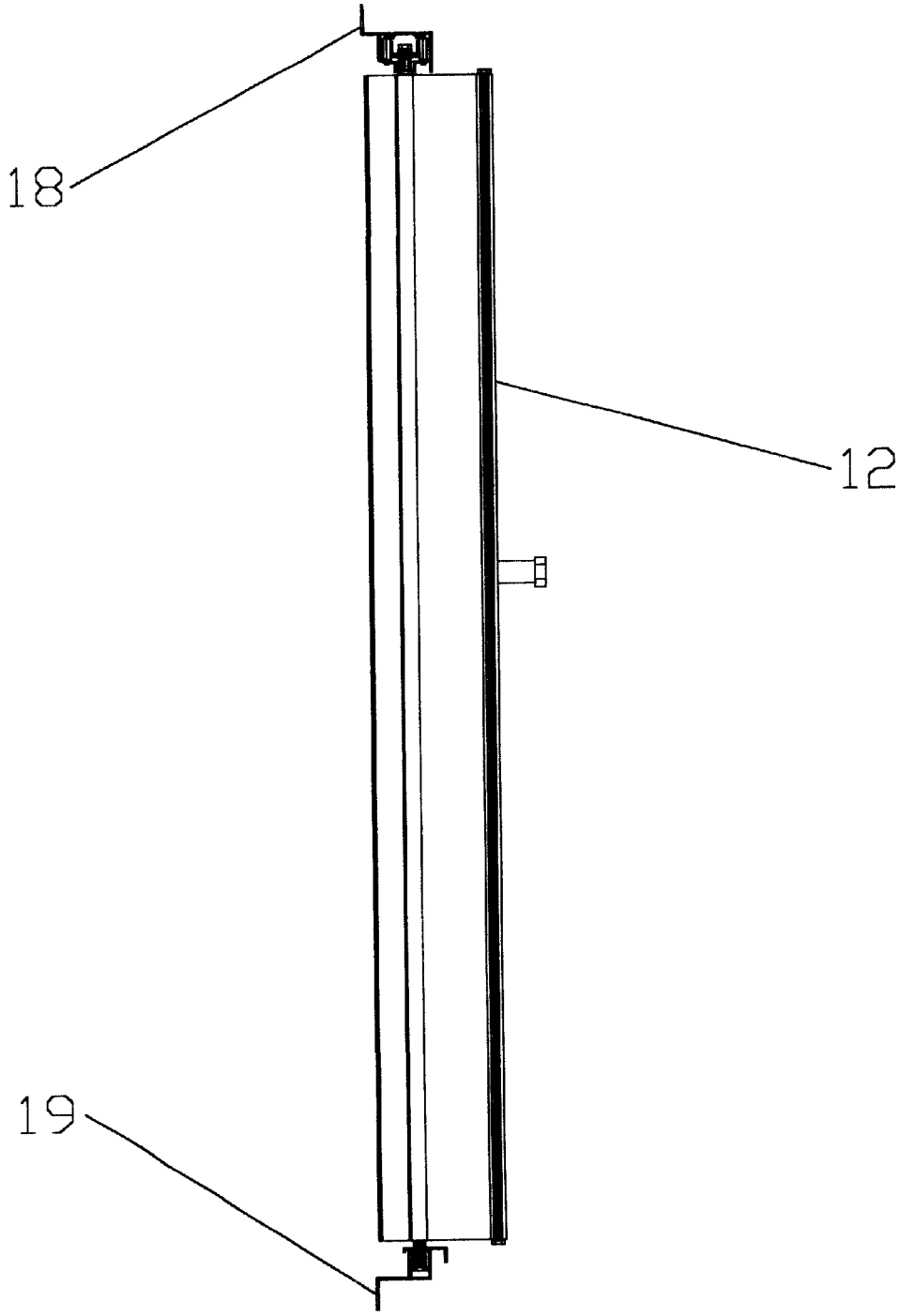
FIG. 3 is a vertical end view of an accordion shutter assembly showing how the header and sill function.
Figure 4:
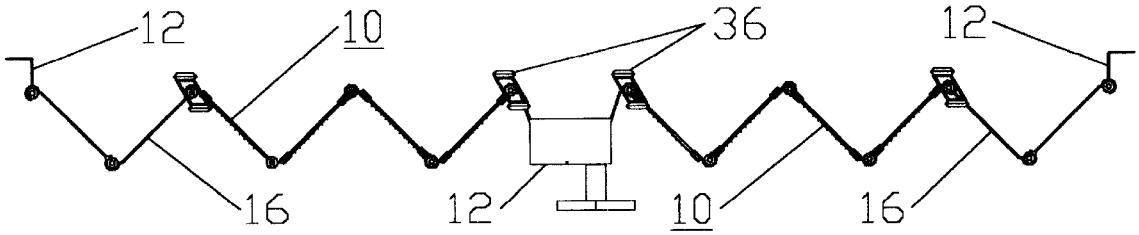
FIG. 4 is a top view of the present Combination Blade mounted in an accordion shutter assembly along with metal blades.
Figure 5:
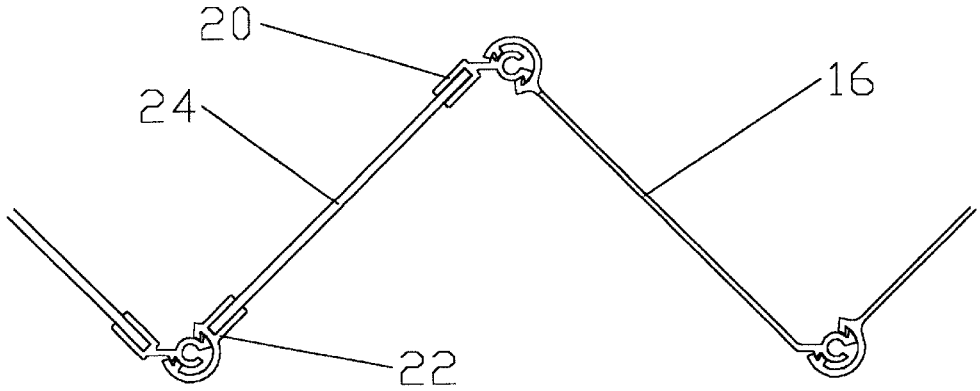
FIG. 5 is an exploded-top view showing present Combination Blade assembled with a steel blade.
Figure 6:
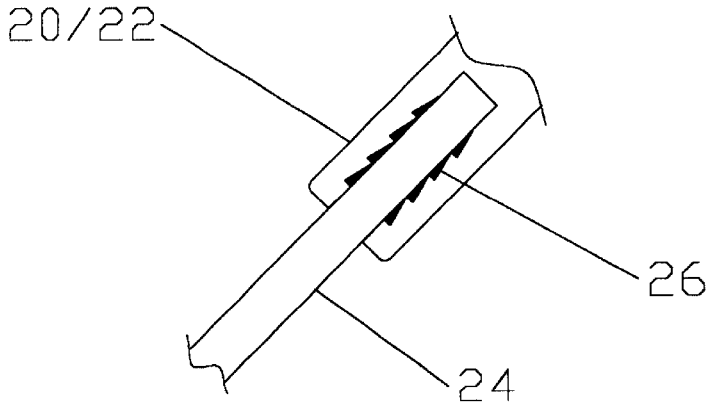
FIG. 6 is an exploded view of the connection of the Combination Blade aluminum hinges and the plastic web showing the formed spline of urethane adhesive.

Referring in general to FIGS. 1–6, one embodiment of the present Combination Blade assembly 10 includes a male aluminum hinge 20, a female aluminum hinge 22 and a web of transparent plastic sheet 24. Each Combination Blade 10 has a web of transparent plastic from 4 to 8 inches in width W and any length L up to 14 feet with a male aluminum hinge attached with an urethane adhesive spline 26 running the length of the web 24 and a female aluminum hinge attached with an urethane adhesive spline 26 running the length of the opposite edge of the web 24. The preferred plastic material for making the web 24 is a double sided UV stabilized polycarbonate plastic. When such a material is used, satisfactory results have been obtained using a web of plastic sheet 24 having a wall thickness T of about 0.093 inches. However, it is believed that other wall thickness' T may produce satisfactory results, and therefore the present invention is not intended to be so limited. For example, a wall thickness T of up to 0.062 inches, up to 0.093 inches, up to 0.125 inches or even more may also produce satisfactory results. Each Combination Blade assembly 10 is made with a male aluminum hinge configuration 20 and female aluminum hinge configuration 22 that imitates and mates with existing metal blades 16 used to manufacture accordion storm shutter assemblies allowing the same hex head bolts 30, washers 32, nylon bushings 34, roller assemblies 36 and methods to be used for attaching the Combination Blade to the accordion shutter assembly 12. The present invention allows accordion shutters that are now made with all metal blades 16 to be made with some metal blades 16 and some Combination Blades 10 for a partial transparent accordion shutter or with all Combination Blades 10 for an all transparent accordion shutter.

The use of present invention does not effect the attachment of the accordion shutter assembly 12 to a structure to protect window and doors. The same hex head bolts 30, washers 32, nylon bushings 34, roller assemblies 36 and methods of attachment that have been tested and used for years can still be used, making the Combination Blade 10 very user friendly.

To replace a metal blade with a Combination Blade the folding blade assembly of an accordion shutter assembly is removed from the assembly. Then the hex head bolts 30, flat washers 32, nylon bushings 34 and roller assemblies 36 are removed from the top and bottom of the existing blade, the blade is slid out and a Combination Blade is slid in its place, the hex head bolts 30, flat washers 32, nylon bushings 34 and roller assemblies 36 are replaced, then the folding blade assembly is replaced in the accordion shutter assembly.

Several exemplary Combination Blades 10 mounted in an accordion shutter assembly 12 have successfully passed a large missile impact test performed according to the Southern Building Code Congress International (SBCCI) Standard for Windborne Debris Impact Test (SSTD 12-99). The exemplary Combination Blades had webs of transparent plastic sheet 24 four to eight inches in width W and 157 inches in length L with a female aluminum hinge 20 and a male aluminum hinge 22 the length of the plastic web 24, attached with an urethane adhesive spline 26 that formed in the grooves for added strength. Each exemplary web of transparent plastic sheet 24 was made of the previously described polycabonate material. The Combination Blades 10 were mounted in an accordion shutter assembly 12 and the accordion shutter 12 attached by its standard methods to an opening made of concrete masonry units. The exemplary Combination Blades successfully withstood the impact of a length of 2×4 lumber weighing nine pounds, traveling at a speed of 50 feet per second. Storm shutters using corrugated or flat sheets of polycarbonate with aluminum or steel reinforcements have not been able to pass this test unless material thickness was too thick for practical applications.

Because the present Combination Blade 10 is mounted in a already proven accordion shutter assembly 12 and the shatter resistant transparent plastic is held firmly in place on only two opposite edges, the thermal expansion and contraction of the web of transparent plastic sheet 24 is restricted without the risk of damage taught by prior art. This allows the present Combination Blade 10 to be mounted with less elaborate and less expensive mounting mechanisms, in a manner already used to make accordion shutter assemblies 12, making it much more consumer friendly then the methods previously used to mount transparent storm shutters. The Combination Blade 10 has the added benefit of enabling thinner sheets of the plastic material to be used while still providing the same or better degree of impact resistance afforded by much thicker flat sheets or corrugated sheets of the same plastic material.

From the above disclosure of the general principles of the present invention and the preceding detailed description, those skilled in the art will readily comprehend the various modifications to which the present invention is susceptible. Therefore, only the following claims and equivalents should limit the scope of the invention thereof

I claim:

1. A transparent combination blade to replace a metal blade in an accordion shutter assembly for protecting glass window or door in a walled structure, comprising:

a combination blade consisting of a web constructed from a flat sheet of shatter resistant and transparent plastic material and two hinges running parallel to the length, male and female, made of aluminum extrusions glued and mechanically held together with an urethane adhesive that forms a spline in the hinge serrations when hardened that can replace a metal blade in an accordion storm shutter assembly using the same hardware that held a metal blade in place holding a combination blade in place in an accordion storm shutter; and resist impact of flying debris in a storm and an impact of a wood two by four weighing nine pounds traveling at a speed of fifty feet per second without penetration.

2. The web of shatter resistant and transparent flat sheet plastic of claim 1, each said sheet have a thickness of up to about 0.125 inches.

3. The web of shatter resistant and transparent flat sheet plastic of claim 1, each said sheet have a thickness of up to about 0.093 inches.

4. The web of shatter resistant and transparent flat sheet plastic of claim 1, each said sheet have a thickness of up to about 0.062 inches.

5. The web of shatter resistant and transparent flat sheet plastic of claim 1, each said sheet having a width in the range from four to eight inches.

6. The web of shatter resistant and transparent flat sheet plastic of claim 1, each said sheet having a length in the range from three to fourteen feet.

7. The combination blade of claim 1, each said blade having a male and female hinge configured to fit and replace metal blades in existing accordion storm shutter assemblies.

8. A transparent combination blade to replace a metal blade in an accordion shutter assembly for protecting glass window or door in a walled structure, comprising: a combination blade consisting of a web constructed from a flat sheet of shattered resistant and transparent plastic material and two hinges running parallel to the length, male and female, made of aluminum extrusions glued and mechanically held together with an urethane adhesive that forms a spline in the hinge serrations when hardened, that spline being unique and giving additional mechanical strength to the combination blade joints.

9. The combination blade of claim 8, each having a spline in the joints between the web and aluminum hinges that spline constructed of an urethane adhesive that is formed in the hinge serrations, this unique method of joining the web and hinges adds the strength needed to withstand the impact of a nine pound wood two by four traveling at fifty feet per second without penetration of the combination blade in an accordion storm shutter assembly, without the spline of urethane adhesive the blade failed the foregoing impact test.

* * * * *